US007555230B2

(12) United States Patent
Mukataka et al.

(10) Patent No.: US 7,555,230 B2
(45) Date of Patent: Jun. 30, 2009

(54) IMAGE FORMING APPARATUS THAT GENERATES A DIFFERENT LIGHT PATTERN FOR DIFFERENT DEVELOPMENT APPARATUSES

(75) Inventors: Hisashi Mukataka, Chuo-ku (JP); Hidetoshi Miyamoto, Chuo-ku (JP); Hideya Muramoto, Chuo-ku (JP); Minoru Wada, Kawanishi (JP); Eiji Gyoutoku, Chuo-ku (JP)

(73) Assignee: Kyocera Mita Corporation, Osaka (JP)

( * ) Notice: Subject to any disclaimer, the term of this patent is extended or adjusted under 35 U.S.C. 154(b) by 287 days.

(21) Appl. No.: 11/396,274

(22) Filed: Mar. 31, 2006

(65) Prior Publication Data

US 2006/0222383 A1 Oct. 5, 2006

(30) Foreign Application Priority Data

Mar. 31, 2005 (JP) ..... 2005-102402

(51) Int. Cl.
*G03G 15/08* (2006.01)

(52) U.S. Cl. ..... 399/27; 399/28

(58) Field of Classification Search ..... 399/130, 399/227, 228, 27, 28

See application file for complete search history.

(56) References Cited

U.S. PATENT DOCUMENTS 6,308,018 B1 * 10/2001 Yoshida et al. ..... 399/53

2004/0057753 A1 * 3/2004 Choi et al. ..... 399/228

FOREIGN PATENT DOCUMENTS

JP 2001-215784 A 8/2001

* cited by examiner

*Primary Examiner*—Quana M Grainger

(57) ABSTRACT

A low cost image forming apparatus can be provided in which the amount of remaining toner of each color in each development apparatus can be detected by a single detection sensor device and at the same time whether the development apparatus is attached to or detached from the image forming apparatus can be discerned by the detection sensor device. The image forming apparatus includes development apparatuses for each color for developing an electrostatic latent image and supply of the developer is controlled based on the detected amount of toner in each of the development apparatuses. The detection sensor device includes a light emitting member and a light receiving member which receives the light emitted from the light emitting member and output a detection signal in accordance with the intensity of received light. Each of the development apparatuses has a light path member or members and the light emitted from the light emitting member advances through the light path member or members in which the light is formed into a light different in pattern with respect to each development apparatus. Therefore, the development apparatus brought to the developing position can be discerned and the amount of toner in the development apparatus can be determined based on the detection signal, thereby supply of developer to the development apparatus is controlled.

10 Claims, 9 Drawing Sheets

IMAGE FORMING APPARATUS THAT GENERATES A DIFFERENT LIGHT PATTERN FOR DIFFERENT DEVELOPMENT APPARATUSES

BACKGROUND OF THE INVENTION

1. Field of the Invention

The present invention relates to an image forming apparatus using elecrophograpic process such as a copying machine, printer, facsimile, specifically to an image forming apparatus in which the amount of developer of each color can be detected by a single detecting sensor when forming color images.

2. Description of the Related Art

Generally, in image forming apparatuses such as copying machines, printers, or facsimiles, an image retaining member such a photoreceptor drum is uniformly exposed, then an electrostatic latent image is formed on the photoreceptor drum by exposing it corresponding to image data, and the electrostatic latent image is developed by a development apparatus to form a toner image on the photoreceptor drum. Then the toner image is transferred onto a recording sheet of paper and fused by a fusing device and the sheet of paper is discharged to a catch tray.

In these image forming apparatuses, toner is supplied to the development apparatus from a toner tank provided separate from the development apparatuses or development cartridges, and toner supply is controlled by detecting the amount of toner in the development apparatus or development cartridge when supplying toner thereto from the toner tank.

Optical sensors are used to detect the amount of toner in a development apparatus, for example. In order to detect accurately the amount of toner remaining in three hoppers provided in a development cartridge, a mirror, half mirrors, and windows are provided to the partition walls of the hoppers the light emitted from a light emitting means located outside the development cartridge is reflected from the mirror and half mirrors and received by three light receiving means located outside the development cartridge, and the amount of toner in each of the hopper is evaluated based on the time the reflected light is detected per unit time by each of the light receiving devices, thus the amount of toner in a cartridge is detected multiple-step wise and accordingly accurately (see JP2001-215784 A (patent literature 1)).

In this apparatus when applied to a color image forming apparatus, there are provided a plurality of development cartridges, each of the development cartridges being provided with a plurality of agitation members for stirring the toner in three hoppers in the cartridge, a cleaning means being provided at the end of each agitation member; and at least one light emitting means and at least one light receiving means that are located so that the light emitted from the light emitting means passes through at least one hopper and the light reflected from the mirror or half mirrors is received by the light receiving means, thereby the amount of toner remaining in the cartridge being detected. Further, a light reflecting means is provided in the development cartridge accommodating section to enable detection of the presence or absence of the cartridge in addition to detection of the amount of toner remaining in the cartridge.

However, in the image forming apparatus disclosed in patent literature 1, although the amount of toner remaining in the development cartridge of each color can be determined multiple-step wise and also the presence or absence of cartridge can be discerned, it is necessary to provide a set of remaining toner amount detection sensor including a light emitting means and a plurality of light receiving means for each of the development cartridges, which causes increase in cost.

Further, in the image forming apparatus of patent literature 1, a light reflecting means is needed to provide in the development cartridge accommodating section, which also causes increase in cost of the apparatus. Furthermore, as a plurality of mirrors and half mirrors are used in this apparatus, optical paths are complicated, and when malfunction occurs to any one of them, detection of the amount of toner remaining in the cartridge will fail.

As mentioned above, there is a disadvantage in the image forming apparatus of patent literature 1 that the amount of toner in the development cartridges and whether the cartridge is attached to or detached from the development apparatus can not be detected by a single remaining toner amount detection sensor device.

SUMMARY OF THE INVENTION

The object of the present invention is made to solve the problem, and the object is to provide a low cost image forming apparatus in which the amount of remaining toner of each color in each development apparatus can be detected by a single detection sensor device and at the same time whether the development apparatus is attached to or detached from the image forming apparatus can be discerned by said detection sensor device.

The present invention proposes an image forming apparatus comprising a plurality of development apparatuses for a plurality of colors to develop electrostatic latent images for a plurality of colors formed on an image retaining member, and a developer supply means for supplying toner of each color to each of the development apparatuses, the toner of each color being supplied to each of the development apparatuses in accordance with the amount of toner in each of the development apparatuses, and further comprising a sensor device including a light emitting member and a light receiving member which outputs upon receiving light a detection signal in accordance with the intensity of the received light, and a pattern forming means provided to each of the development apparatuses for forming the light emitted from said light emitting member into a light which is different in pattern for each of said development apparatuses when a concerned one among the development apparatuses is brought to a developing position in the image forming apparatus, and a control means which discerns said concerned development apparatus brought to the developing position and at the same time determines an amount of developer existing in the concerned development apparatus based on the detection signal, and which controls the developer supply means based on the determination to control supply of developer to the concerned development apparatus.

In the invention, each of the development apparatuses is provided with a first light path member to conduct the light from the light emitting member and allow the light to exit from a light exit surface of the first light path member; the light receiving member is located such that the member is positioned opposite to the light exit surface when each of the development apparatuses is brought to the developing position; the pattern forming means includes a base part rotatably mounted to the development apparatus, the base part having a center axis extending in a transverse direction not intersecting an optical axis of light exiting from the light exit surface and an arm part located on the base part offset from the center axis thereof such that the arm part extends in a transverse direction intersecting the optical axis of light exiting from the light exit surface, the arm part being located between the light exit surface and the light receiving member, the light emitted from the light emitting member is formed into a pulsed light by intermittently interrupting the light by said arm parts by the rotation of the base part.

In the invention, each of the first light path members of each of the development apparatuses has a light transmission coefficient different from each other and each of the base parts is rotated at the same rotation speed.

In the invention, it is suitable that each of the first light path members of each of the development apparatuses has a same light transmission coefficient and each base part of each of the development apparatuses is rotated at a rotation speed different from each other.

Further, it is also suitable that a plurality of said arm parts are provided such that angle spacing between them located to sandwich a straight line parallel to the center axis of the base part is different with respect to each of the development apparatuses, and each base part of each of the development apparatuses is rotated at a same rotation speed.

In the invention, a second light path member having a light entrance surface facing to the light exit surface is provided, the arm parts are located between the light exit surface and light entrance surface, whereby output light from the second light path member is received by said light receiving member. Further, a development unit employs the development apparatuses for each of colors, said detection sensor device is fixed to a housing of the image forming apparatus, and each of the development apparatuses is moved to be brought sequentially to the developing position.

Further, in the invention, a reflection plane is formed on the first light path member so that the light advanced in the first light path member is reflected from the reflection plane to the direction of the optical axis of the second light path member of which the direction of the optical axis is not the same as that of the optical axis of the first light path member. A cleaning pad is attached to the arm part for cleaning the light exit surface and light entrance surface.

As has been described in the forgoing, the image forming apparatus of the present invention is composed such that, the light from the light emitting member is converted into a light different in pattern for each of the development apparatuses when any one of them is brought to the developing position and the converted light is received by the light receiving member, the development apparatus brought to the developing position is discerned and at the same time the amount of toner in the development apparatus is determined based on the detection signal from the light receiving member, thereby developer supply is controlled based on the determination. Therefore, the amount of toner of each color remaining in each of the development apparatuses can be determined by a single detection sensor device to control the supply developer to each development apparatus.

In the present invention, as light transmission coefficient of each of the first light path members is different from each other and the each of the base parts is rotated at the same rotation speed, the amplitude of the detection signal outputted from the light receiving member is different form each of the development apparatuses because of difference in light transmission coefficient, the development apparatus brought to the developing position can be identified by the amplitude showing a high level of the detection signal, and further, as the length of period of high level of the detection signal is different depending on the amount of toner remaining in the development apparatus, the remaining toner amount can be determined based on the length of high level period of the detection signal.

In the present invention, the development apparatus brought to the developing position can be identified by the interval of pulse of the detection signal outputted from the light receiving member by composing such that light transmission coefficient of each of the first light path members is the same to each other and each of the base parts is rotated at a rotation speed different from each other, because with this composition the pulse interval varies for each of the development apparatuses, and further, as the length of period of high level of the detection signal is different depending on the amount of toner remaining in the development apparatus, the remaining toner amount can be determined based on the length of high level period of the detection signal.

In the invention, by composing such that a plurality of the arm parts are provided such that angle spacing between the arm parts which is fixed to the base part such that they are located to sandwich a straight line parallel to the center axis of the base part is different for each development apparatus and the base part is rotated at the same rotation speed, the pulse pattern of the detection signal, specifically the pulse interval of high level of the signal differs for each development apparatus, therefore the development apparatus brought to the developing position can be identified by the pulse interval of the detection signal, and further, as the length of period of high level of the detection signal is different depending on the amount of toner remaining in the development apparatus, the remaining toner amount can be determined based on the length of high level period of the detection signal.

In the invention, a reflection plane is formed on said first light path member so that the light advanced in the first light path member is reflected from said reflection plane to the direction of the optical axis of the second light path member of which the direction of the optical axis is not the same as that of the optical axis of the first light path member, so when any one of development apparatuses is detached from the development unit, the light from the light emitting member can not be received by the light receiving member and the detection signal shows a low level by which the absence of the development apparatuses can be recognized. Therefore, not only the discernment of development apparatus and determination of the amount of toner remaining in the development apparatus are possible, but also whether the development apparatus is detached or not can be recognized.

BRIEF DESCRIPTION OF THE DRAWINGS

FIG. 4A shows the output voltage signal from the light receiving member when the amount of toner is large.

FIG. 6A shows the output voltage signal from the light receiving member when the amount of toner is large.

FIG. 7A shows the output voltage signal from the light receiving member when the amount of toner is large.

FIG. 8A shows the output voltage signal from the light receiving member when the amount of toner is large.

FIG. 8A shows the output voltage signal from the light receiving member when the amount of toner is large.

FIG. 10A shows the output voltage signal from the light receiving member when the amount of toner is large.

FIG. 11A shows the output voltage signal from the light receiving member when the amount of toner is large.

FIG. 12A shows the output voltage signal from the light receiving member when the amount of toner is large.

FIG. 13A shows the output voltage signal from the light receiving member when the amount of toner is large.

FIG. 14A shows the output voltage signal from the light receiving member when the amount of toner is large.

FIG. 15A shows the output voltage signal from the light receiving member when the amount of toner is large.

DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
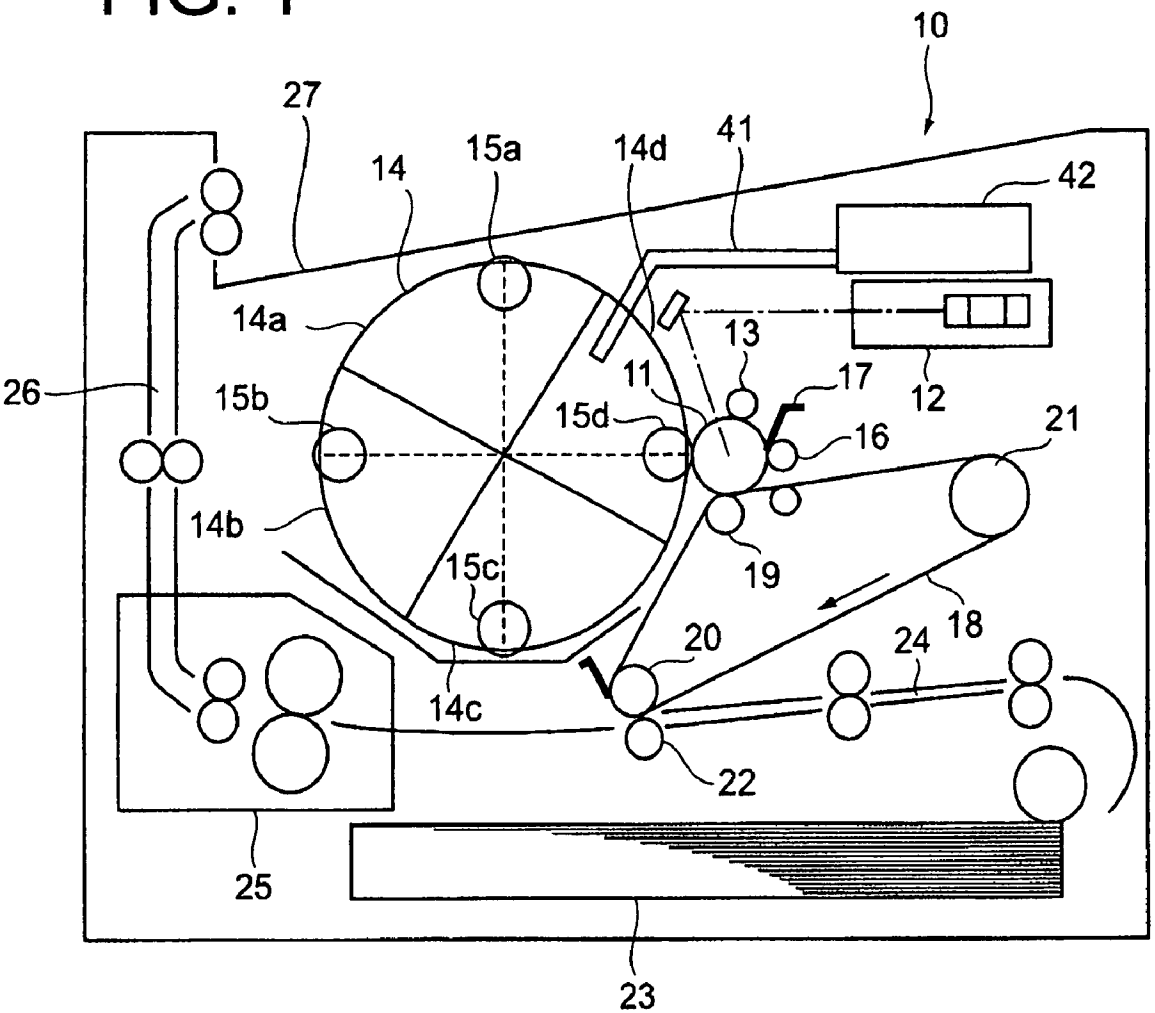
FIG. 1 is a schematic representation of an example of the image forming apparatus according to the present invention.

FIG. 1 is a schematic representation of an example of the color image forming apparatus using an embodiment of the development apparatus according to the present invention. In the drawing, an image forming apparatus 10 includes an image retaining member (photoreceptor drum) 11, a laser scanning unit 12, an electric charging device (charging roller) 13, and a rotary development unit 14. The development unit 14 includes development devices 14*a*~14*d* for each color. These development devices 14*a*~14*d* are detachable from the development unit 14.

The development unit 14 includes, for example, the development device 14*a* for yellow (Y) toner, development device 14*b* for magenta (M) toner, development device 14*c* for cyan (C) toner, and development device 14*d* for black (BK) toner. Each of the development devices 14*a* to 14*d* has a development roller 15*a* to 15*d* respectively. The development unit 14 is driven by a driving device not shown in the drawing by means of a clutch to bring each of the development rollers 15*a*~15*d* sequentially to the developing position where each of development rollers 15*a*~15*d* faces the photoreceptor drum 11, thereby the electrostatic latent image on the photoreceptor drum 11 is developed to be formed thereon as a toner image.

Around the photoreceptor drum 11 are located a cleaning roller 16 and a cleaning blade 17, and an intermediate transfer belt 18 is provided to be brought into contact with the photoreceptor drum 11 by means of a primary transfer roller 19 which is located to face the photoreceptor drum 11 with the intermediate transfer belt 18 pinched between the photoreceptor drum 11 and primary transfer roller 19. The intermediate transfer belt 18 is looped over a driving roller 20, the primary transfer roller 19, and a follower roller 21, and it is driven by the driving roller 20 to run in the direction of an arrow. A secondary transfer roller 22 is located to face the driving roller 20 pinching the intermediate transfer belt 18 between them.

The toner image on the photoreceptor drum 11 is transferred onto the intermediate transfer belt 18 by means of the primary transfer roller 19 (primary image transfer). A copy sheet is advanced from a sheet feeder cassette 23 to the nip between the driving roller 20 and secondary transfer roller 22 (secondary image transfer) passing through a copy sheet feeding route 24. Then, the copy sheet is advanced to a fusing device 25, where the toner image on the copy sheet is fused, and the copy sheet is advanced through a sheet discharge route 26 to a catch tray 27.

When supplying toner to the development apparatus 14*d*, the development unit 14 is rotated so that the development apparatus 14*d* is brought to the toner supply position (here, the toner supply position coincides with the development position). Then, a toner supply pipe 41 is inserted into the development apparatus 14*d*, and toner is supplied to the development apparatus 14*d* from a toner container 42 as shown in FIG. 1. Although not shown in the drawing, the toner container 42 is provided for each color, and toner of each color is supplied to each of the development apparatuses 14*a*~14*c* when they are brought to the toner supply position respectively (toner supply control).

Figure 2:
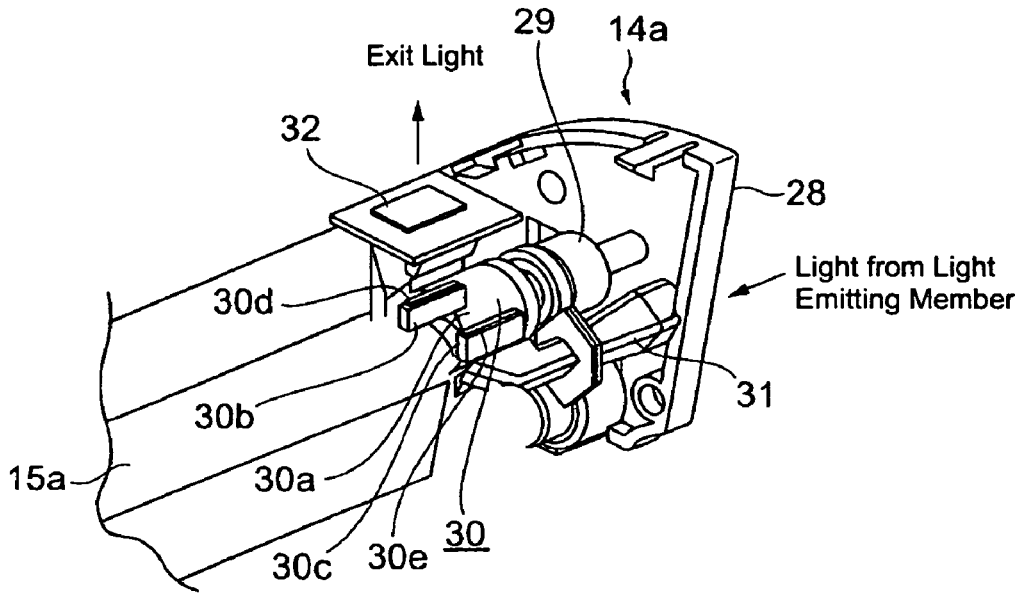
FIG. 2 is a partial perspective view of the development apparatus 14*a* used in the image forming apparatus of FIG. 1.

FIG. 2 is a partial perspective view of the development apparatus 14*a* of Y color (development apparatuses 14*b*~14*d* are composed the same as the development apparatus 14*a*). A shaft member 29 penetrates the side wall of a developer accommodating vessel 28, and a cleaning member 30 is attached to the shaft member 29. The cleaning member 30 has a base part and a pair of arm parts 30*a* and 30*b*(made of nontransparent material) fixed on the base part 30*a*.

In the example shown in FIG. 2, the arm parts 30*b* and 30*c* are offset from the center axis of the base part 30*a* and formed in one piece therewith. Cleaning pad 30*d* and 30*e* are attached respectively to each of the arm parts 30*b* and 30*c* on the outer periphery thereof.

Figure 3:
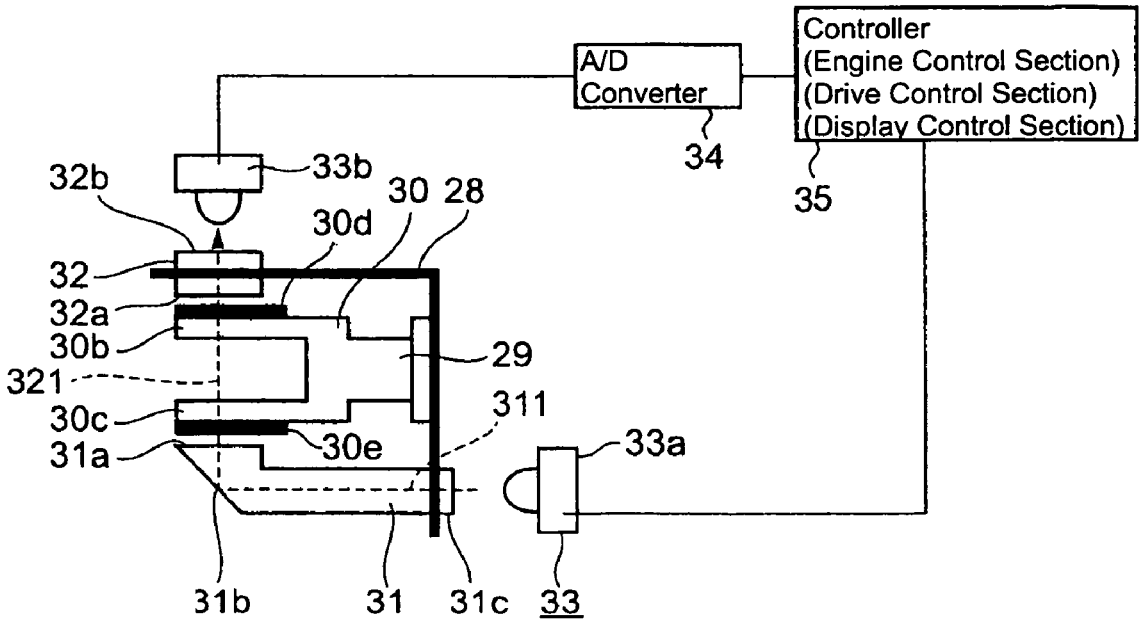
FIG. 3 is a schematic representation of the light path, a detection sensor device, and control system in the development apparatus of FIG. 2.

Here, referring also to FIG. 3, an incident side light path member (incident beam guide path) 31 and an exit side light path member (outgoing beam guide path) 32 are fixed to the vessel 28 such that they sandwich the arm parts 30*b* and 30*c*. As shown in FIG. 3, the light path members 31 and 32 have respectively a light exit surface 31*a* and a light entrance surface 32*a*, and the light exit surface 31*a* and light entrance surface 32*a* are opposing to each other. The light path member 31*b* extends parallel to the shaft member 29, and light reflection plane 31 is formed at an end of the light path member 31. The light traveling in the light path member 31 is reflected at the reflection plane 31*b* and introduced to the light exit surface 31*a*. In the example of FIG. 3, the optical axis 311 of the light path member 31 is orthogonal to the optical axis 321 of the light path member 32.

A remaining toner amount detection sensor device 33 is provided in the apparatus housing (not shown) of the image forming apparatus. The detection sensor device 33 has a light emitting member 33*a* and a light receiving member 33*b*. When the development apparatus 14*a* is brought to the determined position (for example developing position), the light entrance surface 31*c* of the incident light path 31 faces the light emitting member 33*a*, and the light exit surface 32*b* of the light path member 32 faces the light receiving member 33*b*. Therefore, when the development apparatus 14*a* is brought to the determined position, the light emitted from the light emitting member 33*a* travels through the light path member 31 and 32 and enters the light receiving member 33*b*. On the other hand, the cleaning member 30 is rotated to do the sweeping of the light entrance surface 32*a* and light exit surface 31*a* by the cleaning pad 30*d* and 30*e*. When the development apparatuses 14*b*~14*d* are brought to the determined position sequentially, similarly the light emitted from the light emitting member 33*a* enters the light receiving member 33*b*. Each cleaning member 30 provided in each of the development apparatuses 14*a*~14*d* is rotated by means of the same driving source (motor) by way of a gear train at the same rotation speed.

When the cleaning member 30 is rotated and arm parts 30*b* or 30*c* comes to the position to face the light entrance surface 32*a* or the light exit surface 31*a*, the light from the light exit surface 31 is interrupted and does not reach the light entrance surface 32*a*. Further, as the light exit surface 31*a* and light entrance surface 32*a* are exposed to the space in the vessel 28, attenuation of the light traveling in the vessel 28 differs depending on the amount of toner in the vessel 28. Therefore, the amount of light received by the light receiving member 33*b* varies in accordance with the amount of toner in the vessel 28.

As shown in FIG. 3, the light receiving member 33*b* is connected to a controller 35 via an A/D converter 34, and the controller 35 is connected to the light emitting member 33*a* via a driver (driving part, not shown in the drawing). The controller 35 includes an engine control section, drive control section, and display control section, and totally controls the image forming apparatus 10.

Now, in this example, light transmission coefficient of the light path member is different in each of the development apparatuses 14*a*~14*d*. Therefore, even if the intensity of light emitted from the light emitting member 33*a* is the same, the light outgoing from the light exit surface 31*a* is different in intensity in each of the development apparatuses 14*a*~14*d*.

Figure 4A:
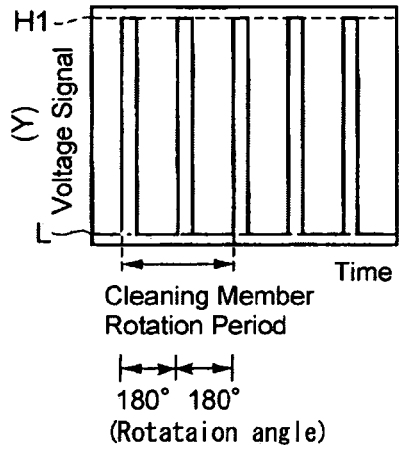
FIGS. 4AB are diagrams showing patterns of detection signal (output voltage signal) from the light receiving member to determine the amount of toner in a development apparatus which uses yellow toner in the first example of the invention.
Figure 7A:
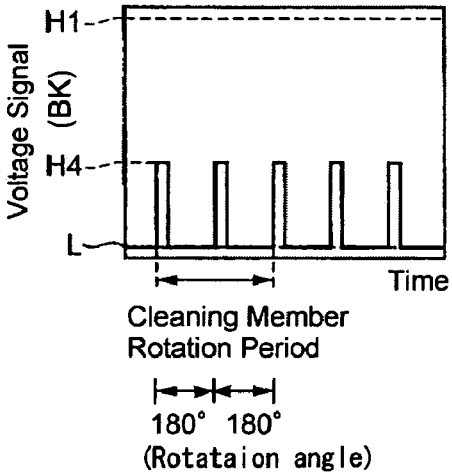
FIGS. 7AB are diagrams showing patterns of detection signal from the light receiving member to determine the amount of toner in a development apparatus which uses black toner in the first example of the invention.

Now, referring also to FIGS. 4AB to FIGS. 7AB, when the development apparatus 14*a* is brought to the developing position, the light emitted from the light emitting member 33*a* travels through the light path member 31 and 32 and received by the light receiving member 33*b* as mentioned above. The light receiving member 33*b* outputs a voltage signal in accordance with the light intensity of the received light (hereafter, the voltage signal corresponding to the development apparatuses 14*a*, i.e. corresponding to Y toner, is referred to as voltage signal Y). Voltage signals outputted from the light receiving member 33*b* when the development apparatuses 14*b* to 14*d* are brought to the developing position are called as voltage signal M, voltage signal C, and voltage signal BK respectively.

As mentioned above, each of the cleaning members 30 is rotated in each of the development apparatuses 14*a* to 14*d*, so the light outgoing from the light exit surface 31*a* is interrupted by the arm parts 30*b* and 30*c* intermittently when the cleaning member 30 rotates. Therefore, the light received by the light receiving member 33*b* is changed to a pulsed light. That is, the cleaning members 30 functions as a pulsed light forming means.

Here, it is assumed that light transmission coefficient is the highest in the light path member 31 of the development apparatuses 14*a* and decreases in the order of the development apparatuses 14*b* to 14*d*.

FIGS. 4AB to FIGS. 7AB show voltage signals Y to BK outputted from the light receiving member 33*b* when the development apparatus 14*d* is brought the developing position. As light transmission coefficient of the light path member 31 of each of the development apparatuses 14*a* to 14*d* is decreased in this order of the development apparatuses 14*a* to 14*d*, when the amplitude of voltage signal Y is H1 (H means high level voltage signal), the amplitude of voltage signals M, C, and BK decrease in this order. Here, high level voltage signals M, C, and BK are H2, H3, and H4 as shown in FIGS. 5, 6, and 7 respectively.

As amplitudes of voltage signals Y to BK differ from each other as mentioned above, by setting beforehand a high level voltage signal for each toner color in the controller 35, the controller 35 can identify which development apparatus is positioned at the developing position by the amplitude of the voltage signal when the controller 35 has received the output signal from the light receiving member 33*b* by way of the A/D converter 34.

Now, when the controller 35 recognizes that the development apparatus 14*a* is positioned at the developing position, the remaining amount of Y toner can be detected by the length of time of high level of the voltage signal Y.

As the light outgoing from the light exit surface 31*a* of the light path member 31 is interrupted periodically by the arm parts 30*b* and 30*c*, the level of voltage signal Y becomes low (L) in intensity when the light is interrupted by the arm parts 30*b* and 30*c*.

Figure 4B:
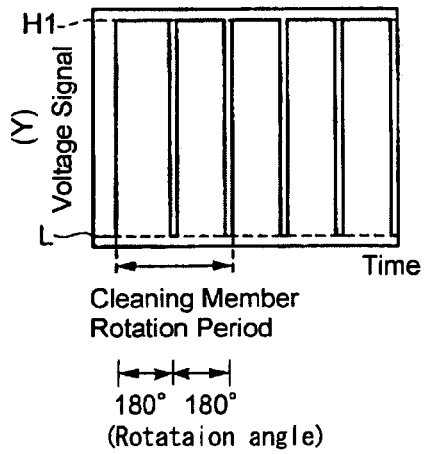
FIG. 4B shows the signal when the amount of toner is small.

The light from the light exit surface 31*a* is also obstructed by Y toner in the development apparatus 14*a*, therefore when the amount of toner present inside the development apparatus 14*a* is large, the period of L level of voltage signal Y is long as shown in FIG. 4A. On the other hand, when the amount of Y toner present inside the development apparatus 14*a* is small, the period of L level of voltage signal Y is short as shown in FIG. 4B. The controller 34 detects the period of high level (H1) for every cycle of voltage signal Y, and judges that Y toner is short in amount when the period of high level of voltage signal Y exceeds the predetermined first threshold value and carry out aforementioned toner supply control to supply Y toner to the development apparatus 14*a*.

On the other hand, the controller 35 judges that Y toner is full in amount when the period of high level of voltage signal Y is shorter than the predetermined second threshold value (the second threshold value<the first threshold value) and stop supplying Y toner.

Figure 5A:
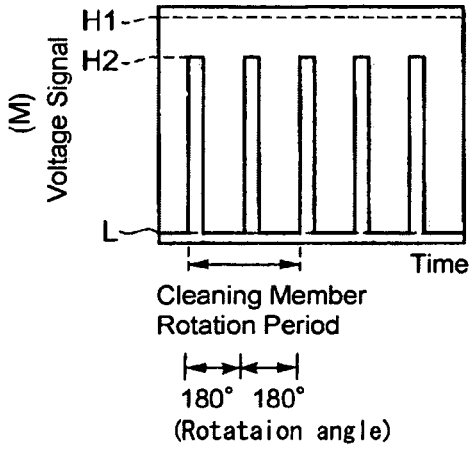
FIGS. 5AB are diagrams showing patterns of detection signal from the light receiving member to determine the amount of toner in a development apparatus which uses magenta toner in the first example of the invention, FIG. 5A the output voltage signal from the light receiving member when the amount of toner is large, and FIG. 5B the signal when the amount of toner is small.
Figure 6A:
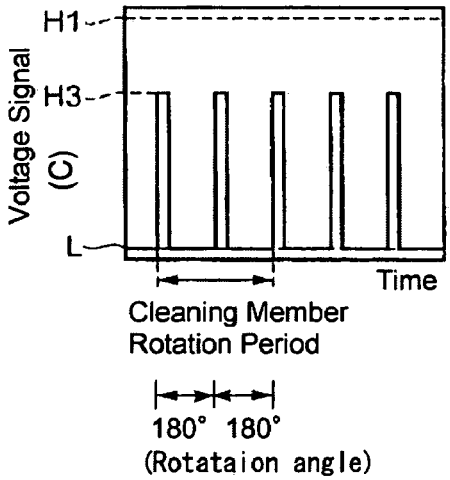
FIGS. 6AB are diagrams showing patterns of detection signal from the light receiving member to determine the amount of toner in a development apparatus which uses cyan toner in the first example of the invention.

The controller 35 judges the amount of remaining toner of M to BK by the length of period of high level of voltage signals M to BK when it is recognized that the development apparatuses 14*b* to 14*d* are positioned at the developing position respectively. In these cases, when M to BK toner in the development apparatuses 14*b* to 14*d* is large in amount respectively, the length of period of L level of voltage signal M to BK is long respectively as shown in FIGS. 5A, 6A, 7A.

Figure 5B:
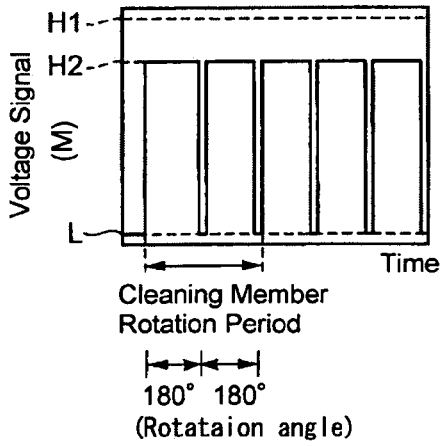
Figure 6B:
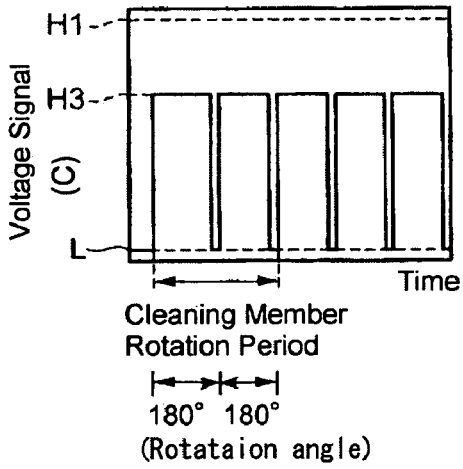
FIG. 6B shows the signal when the amount of toner is small.
Figure 7B:
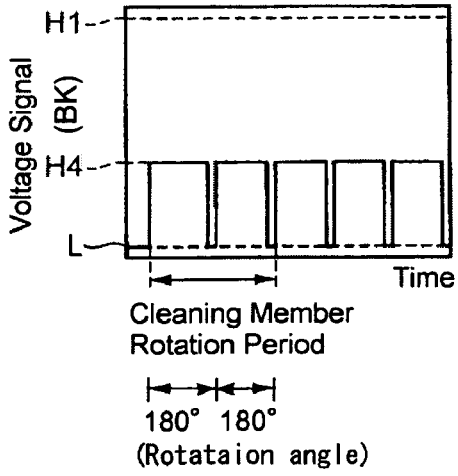
FIG. 7B shows the signal when the amount of toner is small.

When the amount of toner in each of the development apparatuses 14*b* to 14*d* is small, L level period of M to BK toner becomes short as shown in FIG. 5B, 6B, 7B respectively. The controller 35 detects the length of high level (H2 to H4) period for every cycle of each of voltage signals, and judges that M to BK toner is short in amount when the period of high level of voltage signal M to BK exceeds the predetermined first threshold value and carry out aforementioned toner supply control to supply M to BK toner to the development apparatuses 14*b* to 14*d* respectively.

In this way, by using only a single remaining toner amount detection sensor device 30 which includes alight emitting member 33*a* and a light receiving member 33*b*, the development apparatus for each toner color can be recognized and the amount of toner remaining in each development apparatus can be judged. Therefore, the manufacturing cost of the image forming apparatus itself can be reduced.

As each of the cleaning members 30 is rotated at the determined rotational speed, when the cycle periods of voltage signals Y to BK corresponding to the rotational speed of the cleaning member 30 happen to be in disorder, it can be judged that malfunction has occurred in the driving source in the controller 35 or printing speed has changed.

In the example described above, the light transmission coefficient of the light path member 31 of each of the development apparatuses 14*a* to 14*d* is allowed to be different from each other and the cleaning member 30 of each of the development apparatuses 14*a* to 14*d* is rotated at the same rotational speed, however, it is possible to compose such that light transmission coefficient of the light path member 31 of each of the development apparatuses 14*a* to 14*d* is allowed to be the same and the rotational speed of each of the cleaning members 30 is allowed to be different from each other. In this case, the gear ratio of the gear train of each of the development apparatuses 14*a* to 14*d* is made different from each other to allow the rotational speed of each of the cleaning member to be different from each other.

Figure 8A:
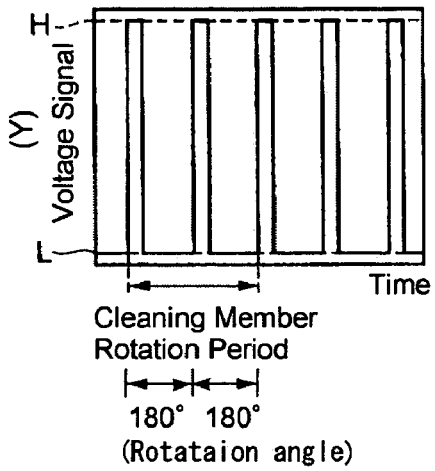
FIGS. 8AB are diagrams showing patterns of detection signal from the light receiving member to determine the amount of toner in a development apparatus which uses yellow toner in the second example of the invention.
Figure 8B:
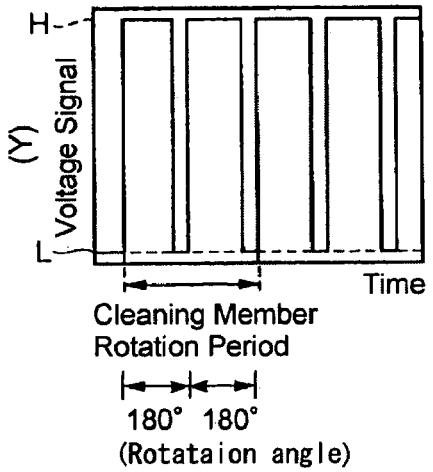
FIG. 8B shows the signal when the amount of toner is small.
Figure 9A:
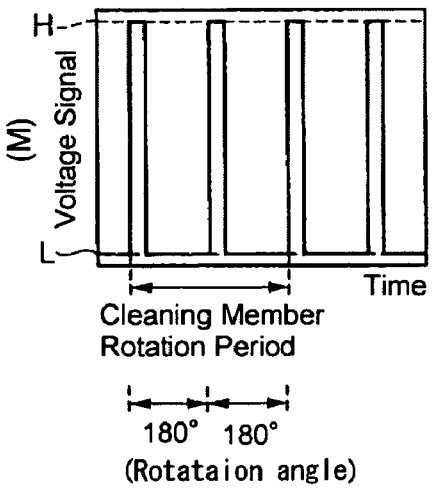
FIGS. 9AB are diagrams showing patterns of detection signal from the light receiving member to determine the amount of toner in a development apparatus which uses magenta toner in the second example of the invention.
Figure 9B:
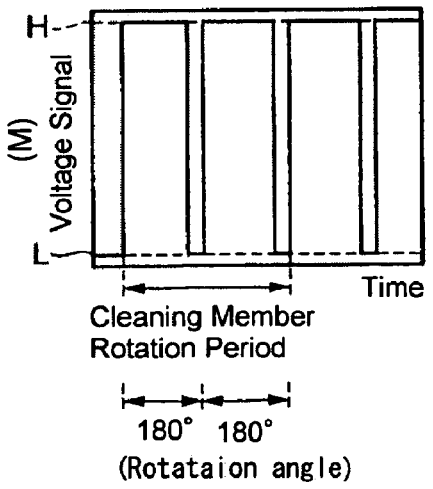
Figure 10A:
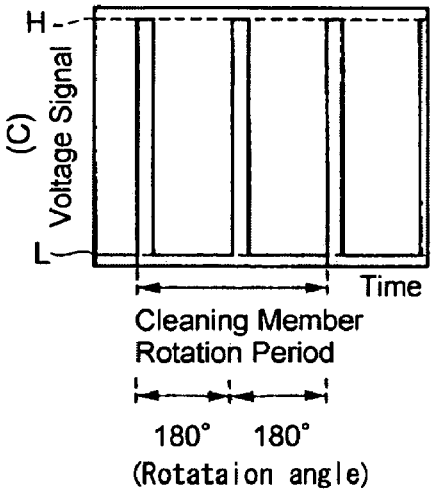
FIGS. 10AB are diagrams showing patterns of detection signal from the light receiving member to determine the amount of toner in a development apparatus which uses cyan toner in the second example of the invention.
Figure 10B:
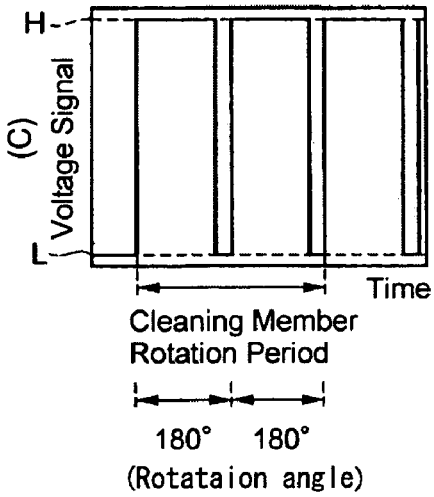
FIG. 10B shows the signal when the amount of toner is small.
Figure 11A:
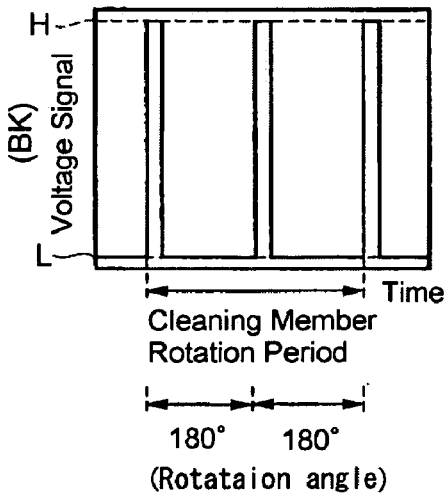
FIGS. 11AB are diagrams showing patterns of detection signal from the light receiving member to determine the amount of toner in a development apparatus which uses black toner in the second example of the invention.
Figure 11B:
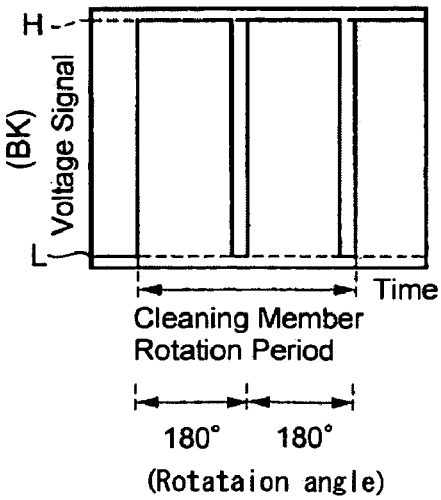
FIG. 11B shows the signal when the amount of toner is small.
Figure 12A:
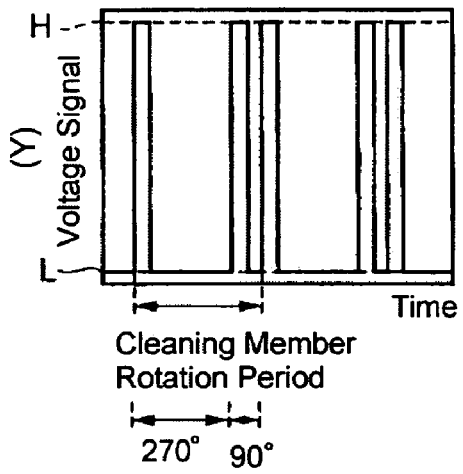
FIGS. 12AB are diagrams showing patterns of detection signal from the light receiving member to determine the amount of toner in a development apparatus which uses yellow toner in the third example of the invention.
Figure 12B:
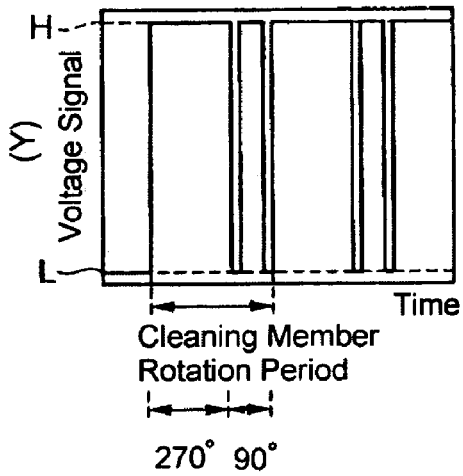
FIG. 12B shows the signal when the amount of toner is small.
Figure 13A:
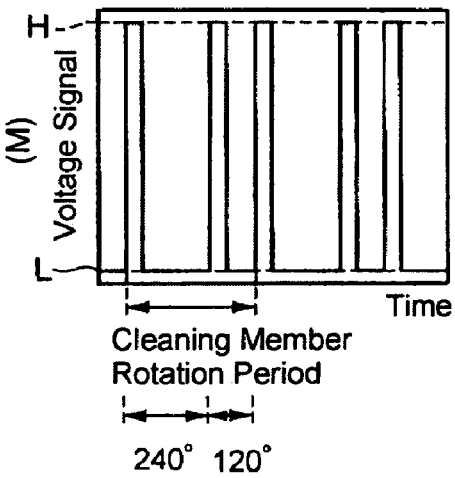
FIGS. 13AB are diagrams showing patterns of detection signal from the light receiving member to determine the amount of toner in a development apparatus which uses magenta toner in the third example of the invention.
Figure 13B:
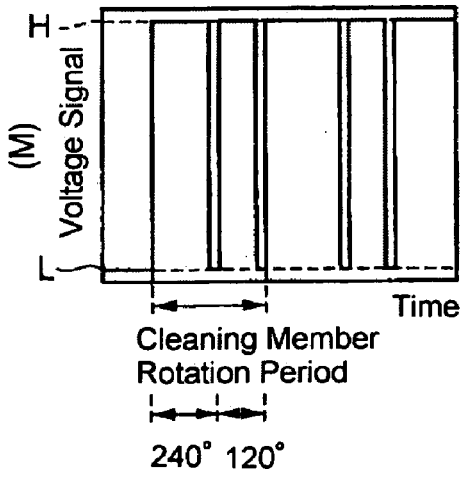
FIG. 13B shows the signal when the amount of toner is small.
Figure 14A:
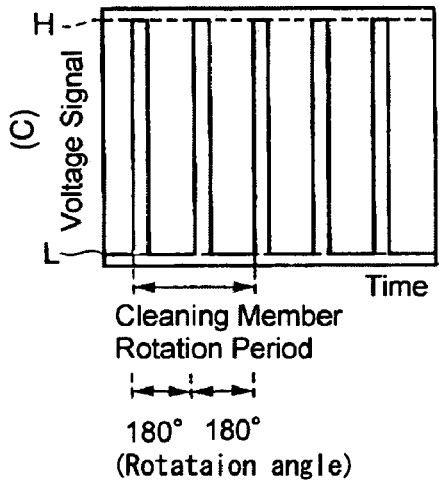
FIGS. 14AB are diagrams showing patterns of detection signal from the light receiving member to determine the amount of toner in a development apparatus which uses cyan toner in the third example of the invention.
Figure 14B:
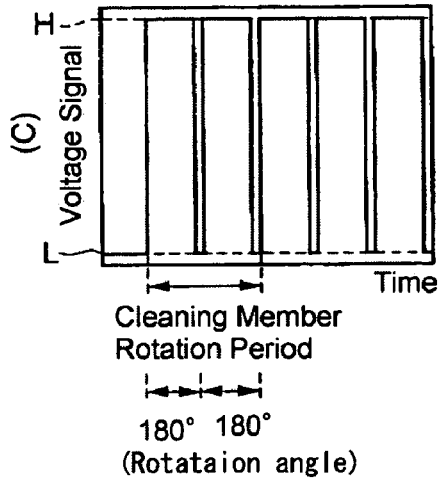
FIG. 14B shows the signal when the amount of toner is small.
Figure 15A:
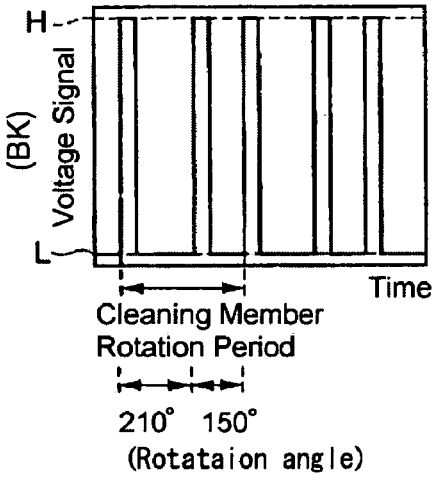
FIGS. 15AB are diagrams showing patterns of detection signal from the light receiving member to determine the amount of toner in a development apparatus which uses black toner in the third example of the invention.
Figure 15B:
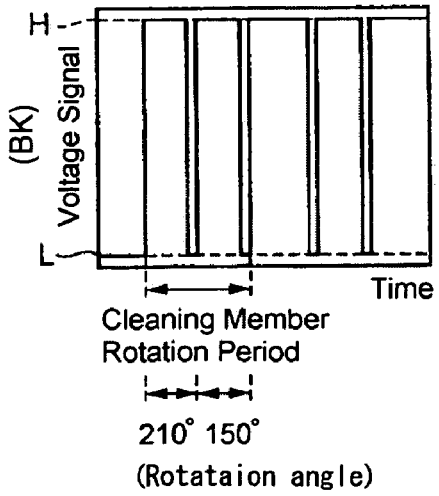
FIG. 15B shows the signal when the amount of toner is small.

Referring to FIGS. 8AB to 11AB showing voltage signal Y to voltage signal BK, the amplitude of each of voltage signals Y to BK, i.e. high level H, is the same level for each of the light path members 31 of the development apparatuses 14*a* to 14*d* because the light transmission coefficient of each light path member 31 is the same. On the other hand, as the rotational speed of each of the cleaning members 30 of the development apparatuses 14*a* to 14*d* is different to each other, cycle periods of voltage signals Y to BK differ from each other as shown in FIGS. 8AB to FIGS. 11AB.

Therefore, by setting beforehand in the controller 35 a cycle period of the voltage signal outputted from the light receiving member 33*b* for each toner color, the controller 35 can discriminate which development apparatus is in the developing position by the cycle period of the signal outputted from the light receiving member 33*b* when the controller 35 has received the signal by way of the A/D converter 34 (see FIGS. 8A, 9A, 10A, 11A).

As to the amount of toner existing in each of the development apparatuses 14*a* to 14*b*, the controller 35 detects the length of period of high level (H) for each of voltage signals each corresponding to the cycle period of the rotational speed of each of the cleaning members 30, and judges that Y to BK toner is short in amount when the period of high level of voltage signal Y to BK exceeds the predetermined first threshold value and carry out aforementioned toner supply control to supply Y to BK toner to the development apparatuses 14*a* to 14*d* respectively (see FIGS. 8B, 9B, 10B, 11B).

Further, it is possible to compose such that the light transmission coefficient of the light path member 31 of each of the development apparatuses 14*a* to 14*d* is the same, also the rotational speed of each cleaning member 30 is the same to each other, and the angle spacing between the arm parts 30*b* and 30*c* of each of the development apparatuses 14*a* to 14*d* is made different to each other. For example, the angle spacing of the members 30*b* and 30*c* is determined such that it is 90° (270°) for the development apparatus 14*a*, 120° (240°) for the development apparatus 14*b*, 180° (180°) for the development apparatus 14*c*, and 150° (210°) for the development apparatus 14*d*.

When the angle spacing between the arm parts 30*b* and 30*c* is made different for each of the development apparatuses 14*a* to 14*d* like this, pulse intervals of voltage signals Y to BK each pulsating in accordance with the rotational speed of the cleaning member 30 are different for each of the development apparatuses 14*a* to 14*d* as shown in FIGS. 12A, 13A, 14A, 15A. Therefore, by setting beforehand in the controller 35 a pulse interval of the voltage signal outputted from the light receiving member 33*b* for each toner color, the controller can recognize which development apparatus is brought to the developing position by the pulse interval for one rotation of the cleaning member 30 when the controller 35 has received the signal by way of the A/D converter 34.

As to the amount of toner existing in each of the development apparatuses 14*a* to 14*d*, the controller 35 detects the length of period high level (H) for each of voltage signals each corresponding to the cycle period of the rotational speed of each of the cleaning members 30, and judges that Y to BK toner is short in amount when the period of high level of voltage signal Y to BK exceeds the predetermined first threshold value and carry out aforementioned toner supply control to supply Y to BK toner to the development apparatuses 14*b* to 14*d* respectively (see FIGS. 12B, 13B, 14B, and 15B).

By the way, the optical axis 311 of the light path member 31 is orthogonal to the optical axis 321 of the light path member 32. Therefore, when the development apparatus 14*a* is detached from the development unit 14 and the section allocated for the development unit 14 has come to the developing position without the development apparatus 14*a*, the light emitted from the light emitting member 33*a* in FIG. 3 advances straight and can not be received by the light receiving member 33*b*.

Figure 16:
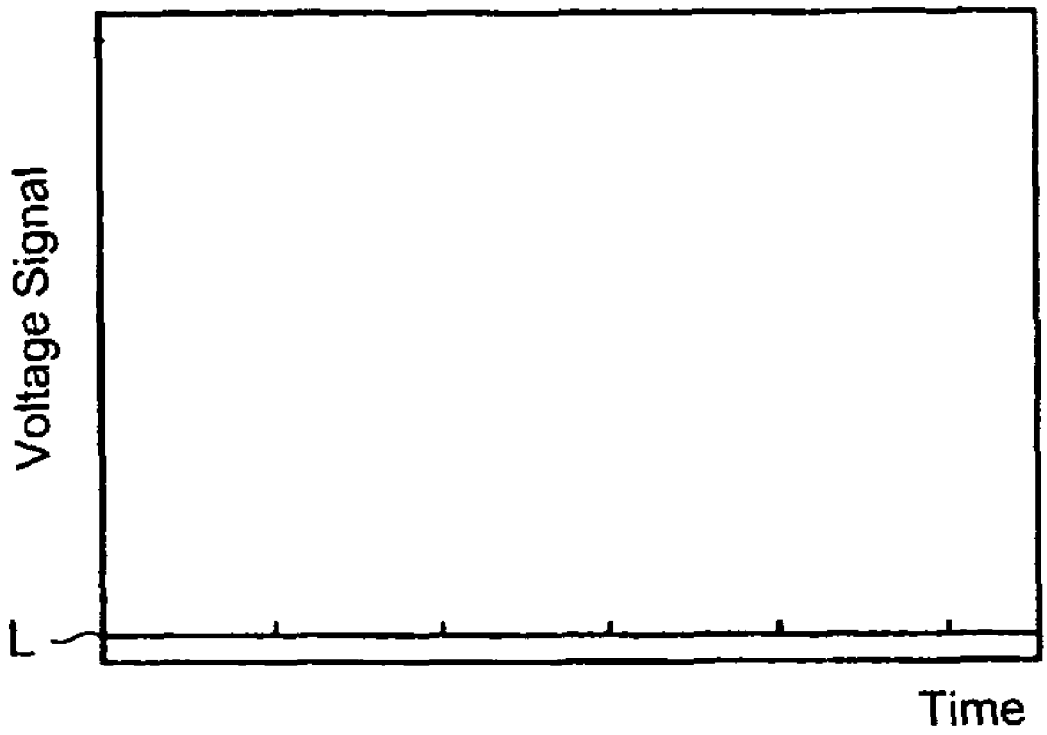
FIG. 16 is a diagram showing a pattern of detection signal from the light receiving member when the development apparatus to be brought to the developing position is detached from the development unit.

Accordingly, the output signal from the light receiving member 33*b* is always low level (see FIG. 16, when the development unit 14*a* is attached to the development unit 14, a high level part exists in the voltage signal irrespective of the amount of toner in the development apparatus 14*a*).

When low level of the voltage signal outputted from the light receiving member 33*b* continues for the predetermined period which is longer than the cycle period of the rotation of the cleaning member 30, the controller 35 recognizes that the development apparatus concerned is detached from the development unit 14 and displays on a panel as such.

Therefore, whether a concerned development apparatus is attached to or detached from the development unit can be judged by the remaining toner amount detection sensor device, and the development unit is further reduced in manufacturing cost.

The image forming apparatus of the invention is composed such that, a sensor device including a light emitting member and a light receiving member is provided, the light emitted from the light emitting member to advance through a development apparatus brought to the developing position in the development unit having a plurality of development apparatuses for a plurality of toner colors is converted into light different in pattern for each of the development apparatuses, the light is received by the light receiving member, the development apparatus brought to the developing position is recognized by the detection signal from the receiving member which has received the light, and at the same time the amount of toner in the concerned development apparatus is judged by said detection signal thereby to control the supply of developing agent. Therefore, the invention can be applied to a color image forming apparatus to control the amount of toner in each of development apparatuses with reduced cost.

What is claimed is:

1. An image forming apparatus comprising:

a plurality of development apparatuses each for one of a plurality of colors to develop electrostatic images formed on an image retaining member;

a developer supply means for supplying toner of each color to the respective development apparatus, the toner of the respective color being supplied to each of the development apparatuses in accordance with the amount of toner in each of the development apparatuses;

a sensor device including a light emitting member and a light receiving member which outputs upon receiving light a detection signal in accordance with the intensity of the received light;

a pattern forming means provided in each of the development apparatuses for forming a light pattern with the light emitted from said light emitting member, which light pattern is different for each of said development apparatuses when a concerned one among said development apparatuses is brought to a developing position in the image forming apparatus; and a control means which discerns said concerned development apparatus brought to the developing position and at the same time determines an amount of developer existing in said concerned development apparatus based on the detection signal generated from the light received in the light pattern associated with said concerned development apparatus, and which controls said developer supply means based on said determination to control supply of developer to said concerned development apparatus.

2. An image forming apparatus comprising:

a plurality of development apparatuses each for one of a plurality of colors to develop electrostatic images formed on an image retaining member;

a developer supply means for supplying toner of each color to the respective development apparatus, the toner of the respective color being supplied to each of the development apparatuses in accordance with the amount of toner in each of the development apparatuses;

a sensor device including a light emitting member and a light receiving member which outputs upon receiving light a detection signal in accordance with the intensity of the received light;

a pattern forming means provided in each of the development apparatuses for forming a light pattern with the light emitted from said light emitting member, which light pattern is different for each of said development apparatuses when a concerned one among said development apparatuses is brought to a developing position in the image forming apparatus; and a control means which discerns said concerned development apparatus brought to the developing position and at the same time determines an amount of developer existing in said concerned development apparatus based on said detection signal, and which controls said developer supply means based on said determination to control supply of developer to said concerned development apparatus, wherein:

each of said development apparatuses includes a first light path member to conduct the light from said light emitting member and allow the light to exit from a light exit surface of said first light path member, said light receiving member is positioned opposite to said light exit surface when each of said development apparatuses is brought to said developing position, said pattern forming means includes a base part rotatably mounted to the development apparatus, the base part having a center axis extending in a transverse direction not intersecting an optical axis of light exiting from said light exit surface and an arm part located on the base part offset from the center axis thereof such that the arm part extends in a transverse direction intersecting the optical axis of light exiting from said light exit surface, said arm part being located between said light exit surface and said light receiving member, and the light emitted from said light emitting member is formed into a pulsed light by intermittently interrupting the light by said arm part by the rotation of said base part.

3. An image forming apparatus according to claim 2, wherein each of the first light path members of each of the development apparatuses has a light transmission coefficient different from each other, and all of said base parts of the development apparatuses are rotated at a same rotation speed.

4. An image forming apparatus according to claim 2, wherein each of the first light path members of each of the development apparatuses has a same light transmission coefficient and each base part of each of the development apparatuses is rotated at a rotation speed different from each other.

5. An image forming apparatus according to claim 2, wherein a plurality of said arm parts are provided such that angle spacing therebetween located to sandwich a straight line parallel to the center axis of said base part is different with respect to each of the development apparatuses, and all of the base parts of the development apparatuses are rotated at a same rotation speed.

6. An image forming apparatus according to claim 2, further including a second light path member having a light entrance surface facing said light exit surface, said arm part is located between said light exit surface and light entrance surface so that said light receiving member receives the light output from said second light path member.

7. An image forming apparatus according to claim 6, further including a cleaning pad attached to said arm part for cleaning said light exit surface and light entrance surface.

8. An image forming apparatus according to claim 1, further including a development unit that employs said development apparatuses for each of colors, wherein said sensor device is fixed to a housing of the image forming apparatus, and each of said development apparatuses is moved to be brought sequentially to the developing position.

9. An image forming apparatus according to claim 6, further including a reflection plane formed on said first light path member so that the light advanced in the first light path member is reflected from said reflection plane to the direction of the optical axis of said second light path member, which direction of the optical axis of said second light path member is not the same as that of the optical axis of the first light path member.

10. An image forming apparatus comprising:

a plurality of development apparatuses each for one of a plurality of colors to develop electrostatic images formed on an image retaining member;

a developer supply means for supplying toner of each color to the respective development apparatus, the toner of the respective color being supplied to each of the development apparatuses in accordance with the amount of toner in each of the development apparatuses;

a sensor device including a light emitting member and a light receiving member which outputs upon receiving light a detection signal in accordance with the intensity of the received light;

a pattern forming means provided in each of the development apparatuses for forming a light pattern with the light emitted from said light emitting member, which light pattern is different for each of said development apparatuses when a concerned one among said development apparatuses is brought to a developing position in the image forming apparatus; and a control means which discerns said concerned development apparatus brought to the developing position and at the same time determines an amount of developer existing in said concerned development apparatus based on said detection signal, and which controls said developer supply means based on said determination to control supply of developer to said concerned development apparatus, wherein:

the pattern forming means includes a base part rotatably mounted to the development apparatus, the base part having a center axis extending in a transverse direction to a path of the light from said light emitting member, and an arm part located on the base part offset from the center axis thereof such that the arm part extends in a transverse direction intersecting the path of the light from said light emitting member, and the light emitted from said light emitting member is formed into a pulsed light from the rotating arm part intermittently interrupting the light to be received by said receiving member.

* * * * *